US005223053A

United States Patent [19]

Cone et al.

[11] Patent Number: 5,223,053

[45] Date of Patent: Jun. 29, 1993

[54] WARM WORK PROCESSING FOR IRON BASE ALLOY

[75] Inventors: Fred P. Cone; John A. Miller, both of Jupiter, Fla.; Brendan J. Cryns, Shorewood; Robert Zanoni, Milwaukee, both of Wis.

[73] Assignee: United Technologies Corporation, Hartford, Conn.

[21] Appl. No.: 828,542

[22] Filed: Jan. 27, 1992

[51] Int. Cl.[5] ..... C21D 8/00

[52] U.S. Cl. ..... 148/624; 148/608

[58] Field of Search ..... 148/326, 327, 608, 624

[56] References Cited

U.S. PATENT DOCUMENTS

| | | | |
|---|---|---|---|
| 3,065,067 | 11/1962 | Aggen | 420/53 |
| 3,065,068 | 11/1992 | Dyrkacz et al. | 420/47 |
| 3,199,978 | 8/1965 | Brown et al. | 420/53 |
| 3,410,733 | 11/1968 | Martin | 148/120 |
| 3,708,353 | 1/1973 | Athey | 148/608 |
| 3,795,552 | 3/1974 | Kegerise et al. | 148/326 |
| 4,172,742 | 10/1979 | Rowcliffe et al. | 148/326 |
| 4,554,028 | 11/1985 | DeBold et al. | 148/327 |
| 4,608,851 | 9/1986 | Khare | 72/364 |

FOREIGN PATENT DOCUMENTS

| | | | |
|---|---|---|---|
| 58-34129 | 2/1983 | Japan | 148/608 |

*Primary Examiner*—Deborah Yee

*Attorney, Agent, or Firm*—Charles E. Sohl

[57] ABSTRACT

A process for strengthening heavy, thick-section forgings of precipitation age hardenable iron base superalloys. The process includes initial recrystallization to achieve a uniform grain size, intermediate temperature warm working at controlled strain rates and for limited amounts of deformation, and precipitation heat treating. The controlled warm working conditions avoid further recrystallization, thus preserving the strain hardening which improves the mechanical properties.

8 Claims, 2 Drawing Sheets

WARM WORK PROCESSING FOR IRON BASE ALLOY

This invention was made with Government support under a contract awarded by the National Aeronautics and Space Administration. The Government has certain rights in this invention.

TECHNICAL FIELD

The present invention relates to the precipitation age hardenable iron base alloys and more particularly to the thermomechanical processing of precipitation age hardenable iron base superalloys.

BACKGROUND ART

There is an urgent demand in certain aerospace applications for a structural alloy having a yield strength of about 140,000 psi and a tensile strength of about 170,000 psi in heavy, thick-section forgings, along with good resistance to hydrogen embrittlement. Certain precipitation age hardenable iron base superalloys have been developed which are capable of this level of mechanical properties. The A286 alloy, which has a composition, by weight, of 13–15 percent chromium, 24–27 percent nickel, 1–2 percent molybdenum, 1.5–2.5 percent titanium, 0.1–0.5 percent vanadium, 0.003–0.010 percent boron, balance substantially iron, is one of these alloys.

Conventional processing for the A286 alloy includes final deformation cycles at 1800° to 2000° F., solution heat treatment at 1750° to 1800° F. for approximately to 1 hour, and precipitation heat treatment at about 1325° F. for approximately 16 hours. This provides material with a typical yield strength of about 100,000 psi, and a typical tensile strength of about 160,000 psi.

U.S. Pat. No. 3,708,353, issued to Athey and developed by the Pratt & Whitney Division of United Technologies Corporation, describes a method for processing A286 material which provides improved properties. Rolling into sheet or strip in the temperature range of 1,550° to 1,800° F. produces material with extremely small grain size. Subsequent processing includes a stabilization operation at about 1,400° F., followed by aging at about 1,300° F. and provides a typical yield strength of about 160,000 psi and a typical tensile strength of about 175,000 psi.

It has been determined experimentally that applying this processing sequence to the same alloy in much thicker sections does not consistently generate the same level of mechanical properties. In the thin sheet or strip material utilized in U.S. Pat. No. 3,708,353, the rolling and cooling cycles are such that recrystallization of the material, which would dissipate the strain hardening, does not usually occur. For heavy, thick-section forgings, generally greater than about one inch in thickness, which retain heat longer than thinner material, similar thermomechanical processing of the same alloy generally results in recrystallization of the material and relief of the strain hardening imparted during the forging operation, not allowing a consequent improvement in the mechanical properties.

Thus, what is needed is a processing method for heavy, thick-section forgings of precipitation age hardenable iron base superalloys which produces a minimum yield strength of about 140,000 psi and a minimum tensile strength of about 170,000 psi.

DISCLOSURE OF INVENTION

This invention provides a thermomechanical process for producing heavy, thick-section forgings of precipitation age hardenable iron base superalloys with the required properties. The resultant grain structure, which is predominantly unrecrystallized, is essential in achieving strengths significantly superior to conventionally processed material. Key features of the invention process are:

(1) a recrystallization cycle to relieve prior strain hardening and provide a known, uniform starting microstructure;

(2) thermomechanical processing under conditions which avoid further recrystallization; and (3) precipitation heat treating without recrystallization.

By retaining a predominantly unrecrystallized grain structure after the thermomechanical processing operations, the strain hardening imparted during the processing significantly adds to the mechanical properties achieved in the conventional precipitation hardening process and provides the improved mechanical properties necessary for particular applications.

The foregoing and other features and advantages of the present invention will become more apparent from the following description and accompanying drawings.

BEST MODE FOR CARRYING OUT THE INVENTION

Under certain conditions of temperature and strain hardening produced by prior deformation operations, precipitation age hardenable iron base superalloys will undergo recrystallization, i.e., the formation of a fine, uniform microstructure in which strain hardening has been relieved. For a given level of deformation, recrystallization occurs as a function of time at elevated temperature. As the temperature is decreased, longer times are required for recrystallization to occur for any particular amount of deformation. At relatively low temperatures, the times necessary for recrystallization are generally large compared to the time required when higher temperatures or higher amounts of deformation are involved. For this invention process, the effects of time at the thermomechanical processing temperature are minimized compared to the effects of deformation at the specific processing temperatures involved because the processing is done at relatively low temperatures and the deformation process is carefully controlled.

Figure 1:
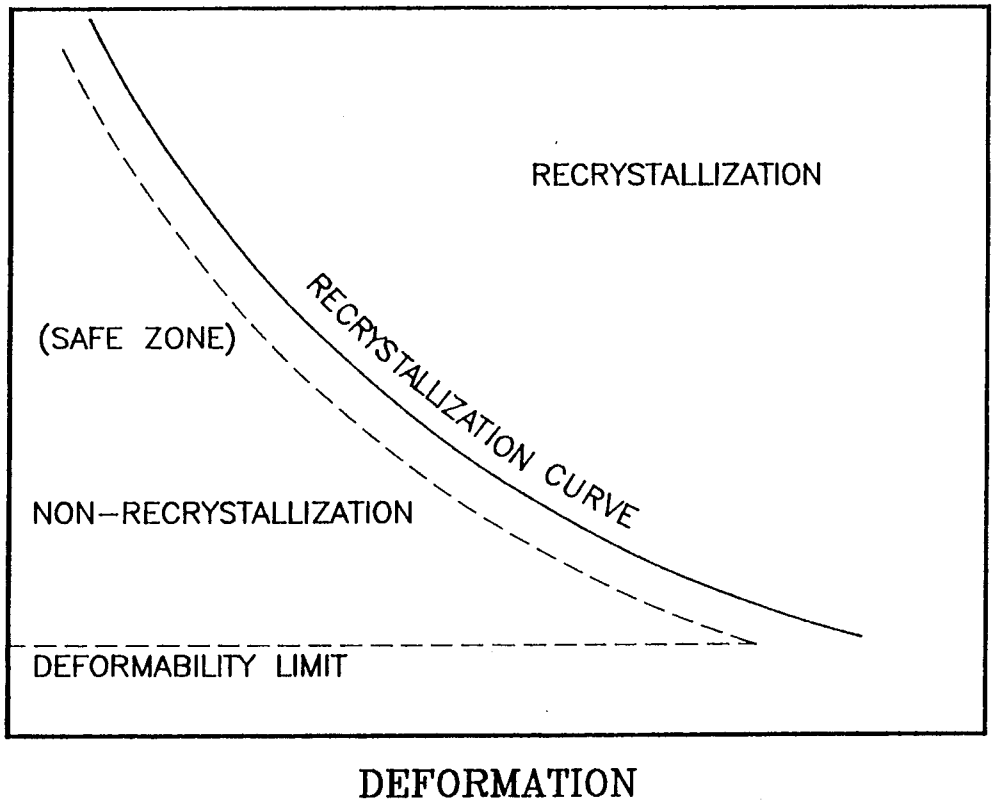
FIG. 1 is a schematic diagram of a recrystallization curve.

As indicated in FIG. 1, recrystallization is promoted by deformation; the recrystallization curve shows that increasing the amount of deformation lowers the temperature at which recrystallization occurs. The general shape of the recrystallization curve has been established quantitatively for this alloy; however, the operations described in this invention require only that the boundary between recrystallizing and nonrecrystallizing regions is understood and operations are conducted within a "safe" portion of this nonrecrystallizing region, as illustrated by the broken lines. The safe region is defined by an upper boundary below and roughly paralleling the recrystallization curve, and a lower boundary representing a minimum temperature necessary to make the material readily deformable in thick sections without cracking by available equipment.

The safe region is established by studying simple forge shapes which contain a known strain gradient. In practice, a series of tapered billets is deformed under different processing conditions, including temperature and initial grain size. The tapered billets are metallographically examined to determine the strain level at which recrystallization occurs. After plotting the results to determine the recrystallization curve, a practical upper boundary for the safe region can be established.

The safe region defines, for practical considerations, the conditions under which the material can be processed while avoiding further recrystallization. The process conducted within the general confines of this safe region is referred to hereinafter as warm working. The position of the recrystallization curve and the safe region will be different for different alloys, but one of ordinary skill in the art will understand that the invention process will apply to other alloys of similar strengthening characteristics.

Figure 2:
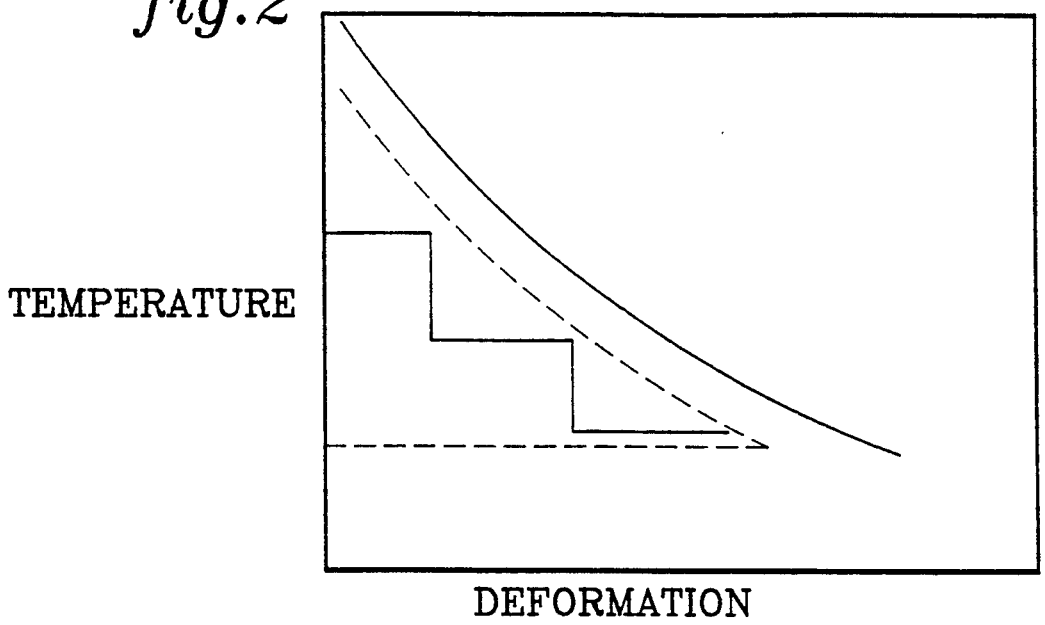
FIG. 2 is a schematic diagram showing how recrystallization can be avoided by repeated heating operations at successively lower temperatures.

FIG. 2 indicates that recrystallization can be avoided by controlling the temperature and deformation and using progressively lower temperatures during a series of warm working operations, thus remaining within the safe region. This applies as long as the warm working temperatures are low enough that time is not an important factor, as discussed above. It is significant to note that the effects of strain hardening imparted due to repeated deformation operations are additive, whether at the same temperature or at different temperatures, as long as recrystallization does not occur.

Figure 3:
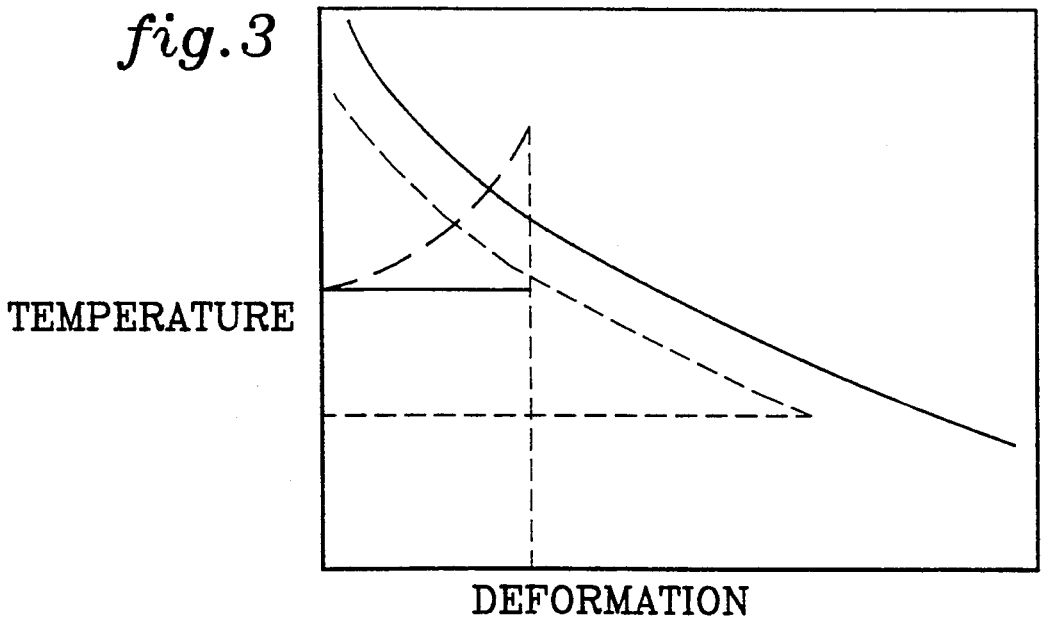
FIG. 3 is a schematic diagram showing how adiabatic heating, due to deformation, can affect recrystallization.

One of the effects of mechanically deforming a metallic object is to generate heat. If the heat generated is not transferred from the object to the surroundings, an increase in temperature of the object, referred to as adiabatic heating, occurs. This effect is illustrated in FIG. 3, which shows that the adiabatic heating can increase the temperature of the object until the deformation-temperature curve, represented in this case by the broken line, crosses the recrystallization curve, allowing recrystallization to occur. The deformation-temperature curve where there is no increase in temperature, represented by the solid line, shows that the same amount of deformation does not result in recrystallization if the heat generated by deformation is balanced by heat loss to the surroundings so that the temperature of the object does not increase.

Adiabatic heating during warm working in a heavy, thick-section forging can be controlled by limiting the amount of deformation and controlling the deformation rate such that the balance between the heat generated and the heat lost to the surroundings limits the increase in temperature of the material enough to prevent crossing of the recrystallization curve. The warm working operations can be performed at a single, relatively low temperature, or as a series of operations at initially higher, but successively decreasing, temperatures, as indicated in FIG. 2.

In order to apply the above concepts to thick-section forgings with complex geometry, the recrystallization results from the tapered billet studies, described above, were correlated with finite element analysis models of the strains in the tapered billet forgings. Having thus correlated the strain parameters of the finite element analysis program with the onset of recrystallization, it is now possible to computer model proposed forged geometries and, when necessary, make adjustments to stay within the safe region and avoid further recrystallization during the forging operations.

Combining all of the aforementioned factors, the following process of this invention was derived as a means of producing high strengths in heavy, thick-section forgings:

(1) Recrystallize prior to heating for the final warm working operations to relieve strain hardening from prior operations and establish a known, uniform starting microstructure with a maximum grain size of about ASTM 2.

(2) Warm work under conditions which avoid further recrystallization.

(3) Precipitation heat treat to increase the strength of the material.

For A286 alloy, the recrystallization is typically conducted at a temperature between 1800° F. and 2000° F. The warm working operations are typically conducted at initial temperatures between 1200° F. and 1700° F., and at deformation rates low enough to control the heat gain relative to the heat loss to the surroundings so as to avoid crossing the recrystallization curve. Precipitation heat treatment is conducted between 1100° F. and 1400° F. for 12 to 48 hours, with multiple precipitation steps sometimes being desirable.

The process of the present invention may be better understood through reference to the following illustrative example.

EXAMPLE I

A starting billet of A286 alloy 12.5 inches in diameter and 18 inches in height was recrystallized by holding at 1,900° F. for one hour and fan air cooling to below 1,000° F. The billet was heated to 1,600° F. and upset forged a total of 43 percent at a press speed of one to two in/sec., and air cooled to approximately 1,200° F. The billet was then reheated to 1,500° F. and forged 30 percent at the same press speed, followed by water quenching. This forged material was then precipitation heat treated at 1,300° F. for 16 hours and air cooled to below 700° F., reheated to 1,200° F. for 16 hours, and air cooled.

Test samples cut from this forging exhibited the room temperature tensile properties shown in Table I; the results show approximately a 50 percent increase in yield strength compared to conventionally processed A286 material, and compare favorably to those reported for sheet material by Athey in U.S. Pat. No. 3,708,353.

TABLE I

| | A286 Conventionally Processed | A286 Patent 3,708,353 | A286 Current Invention |
|---|---|---|---|
| 0.2% yield strength, ksi | 100 | 160 | 144–156 |
| Tensile Strength, ksi | 160 | 175 | 172–183 |
| % Elongation | 22 | 18 | 11–13 |
| % Reduction in Area | 40 | — | 20–25 |

Although this invention has been shown and described with respect to detailed embodiments thereof, it will be understood by those skilled in the art that a process similar to that illustrated for A286 alloy would apply to other precipitation age hardenable iron base superalloys, and that various changes in form and detail of the invention may be made without departing from the spirit and scope of the claimed invention.

We claim:

1. A process for producing heavy, thick-section precipitation age hardenable iron base superalloy forgings comprising:

(a) recrystallizing to provide a known uniform starting microstructure;

(b) warm working under conditions which do not permit recrystallization; and (c) precipitation heat treating;

whereby the resultant material has a minimum yield strength of about 140,000 psi and a minimum tensile strength of about 170,000 psi.

2. A process as recited in claim 1, whereby said warm working consists of a series of controlled deformation rate steps controlled so that adiabatic heating does not cause recrystallization.

3. A process as recited in claim 2, whereby said series of controlled deformation rate steps are performed at a progressively lower starting temperature for each of said controlled deformation rate steps.

4. A process as recited in claim 1, whereby said precipitation heat treating consists of multiple precipitation steps.

5. A process as recited in claim 1, whereby said precipitation age hardenable iron base superalloy consists of essentially, by weight, about 13–15 percent chromium, 24–27 percent nickel, 1–2 percent molybdenum, 1.5–2.5 percent titanium, 0.1–0.5 percent vanadium, 0.003–0.010 percent boron, balance iron.

6. A process as recited in claim 5, whereby said precipitation age hardenable iron base superalloy forgings are recrystallized by heating between approximately 1800° F. and 2000° F. prior to warm working for a time sufficient to produce a microstructure with a maximum grain size of about ASTM 2.

7. A process as recited in claim 5, whereby said warm working is conducted at a starting temperature between approximately 1,200° F. and 1,700° F.

8. A process as recited in claim 5, whereby said precipitation heat treating is performed between approximately 1,100° F. and 1,400° F. for a period of 12–48 hours.

* * * * *